US010689908B2

(12) United States Patent
Mora et al.

(10) Patent No.: US 10,689,908 B2
(45) **Date of Patent: *Jun. 23, 2020**

(54) END CAP WITH GRIP AND RAG HOLDER

(71) Applicants: Daniel C. Mora, Transfer, PA (US); Robert Beggs, Stoneboro, PA (US); James Anthony Jacobs, New Castle, PA (US)

(72) Inventors: Daniel C. Mora, Transfer, PA (US); Robert Beggs, Stoneboro, PA (US); James Anthony Jacobs, New Castle, PA (US)

(73) Assignee: Werner Co., Greenville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/392,085

(22) Filed: Dec. 28, 2016

(65) Prior Publication Data

US 2018/0179819 A1 Jun. 28, 2018

(51) Int. Cl.

| | |
|---|---|
| ***E06C 7/48*** | (2006.01) |
| ***E06C 7/14*** | (2006.01) |
| ***E06C 1/06*** | (2006.01) |
| ***E06C 7/46*** | (2006.01) |

(52) U.S. Cl.

CPC ..... *E06C 7/48* (2013.01); *E06C 1/06* (2013.01); *E06C 7/14* (2013.01); *E06C 7/46* (2013.01); *E06C 7/482* (2013.01); *E06C 7/486* (2013.01)

(58) Field of Classification Search

CPC ..... E06C 7/48; E06C 7/14; E06C 1/06; E06C 7/482; E06C 7/486

USPC ..... 182/108

See application file for complete search history.

(56) References Cited

U.S. PATENT DOCUMENTS

| | | | | | |
|---|---|---|---|---|---|
| 2,138,171 | A * | 11/1938 | Johnson | E06C 7/48 | 182/111 |
| 2,904,128 | A * | 9/1959 | Boham | E06C 7/48 | 150/154 |
| 4,771,862 | A * | 9/1988 | Garland | E06C 7/48 | 182/108 |
| 4,899,848 | A * | 2/1990 | Parr | E06C 7/48 | 182/108 |
| 4,974,699 | A * | 12/1990 | Boring | E06C 7/48 | 182/107 |
| 5,358,070 | A * | 10/1994 | Bartnicki | E06C 7/14 | 182/129 |
| 5,497,848 | A * | 3/1996 | Travis | E06C 7/486 | 182/107 |

(Continued)

FOREIGN PATENT DOCUMENTS

| | | | | |
|---|---|---|---|---|
| CA | 2671717 | A1 * | 1/2010 | E06C 1/06 |

*Primary Examiner* — Marcus Menezes
(74) *Attorney, Agent, or Firm* — Ansel M. Schwartz

(57) ABSTRACT

A ladder for a user to climb and which holds a rag includes a first rail having a top and a second rail and rungs attached to the first rail and second rail. The ladder includes an end cap that is attached adjacent to the top of the first rail. The end cap having an attachment portion which attaches to the first rail and a cover portion which covers over the first rail, and extends from the attachment portion. The cover portion having a rag holder. The ladder includes a pad attached to the back of the cover portion which contacts a surface against which the first rail leans down so as not to mar or scratch or damage the surface. An end cap. A method.

6 Claims, 5 Drawing Sheets

(56) References Cited

U.S. PATENT DOCUMENTS

| | | | | | |
|---|---|---|---|---|---|
| 5,533,591 | A * | 7/1996 | Kiska | E06C 7/48 | 182/108 |
| 5,913,380 | A * | 6/1999 | Gugel | B25H 3/023 | 182/129 |
| 5,950,761 | A * | 9/1999 | Murphy | E06C 7/48 | 182/108 |
| 5,988,383 | A * | 11/1999 | Armstrong | E06C 7/14 | 182/129 |
| 6,273,289 | B1 * | 8/2001 | Bowman | B44D 3/14 | 220/482 |
| 6,499,563 | B1 * | 12/2002 | Bremick | E06C 7/42 | 182/108 |
| 6,698,548 | B1 * | 3/2004 | Verrill | E06C 1/39 | 182/129 |
| 7,753,170 | B1 * | 7/2010 | Gibson | E06C 7/14 | 182/107 |
| 8,167,088 | B2 * | 5/2012 | Kuhlman | E06C 7/003 | 182/108 |
| 2002/0070136 | A1 * | 6/2002 | Hedges | B25H 3/00 | 206/373 |
| 2014/0083888 | A1 * | 3/2014 | Constable | E06C 7/14 | 206/372 |

* cited by examiner

END CAP WITH GRIP AND RAG HOLDER

FIELD OF THE INVENTION

The present invention is related to an end cap that is attached adjacent to a top of a first rail of a ladder which has a rag holder. (As used herein, references to the "present invention" or "invention" relate to exemplary embodiments and not necessarily to every embodiment encompassed by the appended claims.) More specifically, the present invention is related to an end cap that is attached adjacent to a top of a first rail of a ladder which has a rag holder where the rag holder is formed by a first slot and a second slot in communication with the first slot through a channel in the interior of the end cap.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Whenever a user climbs a ladder, it is extremely common for the user to use one or more objects, such as tools or paintbrushes or paint cans or even rags while standing on the ladder. To make it easier for the user to use these objects, it is advantageous for these objects to have some type of location on the ladder to hold them when the user is not using them at a given moment. By having the objects being held at a convenient location on the ladder, it is not only easier for the user to go back and forth with them while the user is using them, but is also safer for the user to have the objects located in an organized fashion on the ladder so the user does not have to put himself or herself in a precarious position that could result in the user falling off the ladder or dropping the object.

One object that is very commonly used by a user of a ladder is a rag. It would be advantageous and helpful for the user to have a convenient location at the top of the ladder where the user commonly works from the ladder to hold a rag.

BRIEF SUMMARY OF THE INVENTION

The present invention pertains to a ladder for a user to climb and which holds a rag. The ladder comprises a first rail having a top. The ladder comprises a second rail. The ladder comprises rungs attached to the first rail and second rail. The ladder comprises an end cap that is attached adjacent to the top of the first rail. The end cap having an attachment portion which attaches to the first rail and a cover portion which covers over the first rail, and extends from the attachment portion. The cover portion having a front and a back and an interior. The cover portion having a rag holder comprising a first slot and a second slot which communicates through a channel in the interior of the cover portion that extends from the first slot to the second slot, the rag extending into the first slot and through the channel and out the second slot to be held by the rag holder the ladder comprises a pad attached to the back of the cover portion which contacts a surface against which the first rail leans so as not to mar or scratch or damage the surface.

The present invention pertains to an end cap for a top of a first ladder rail for holding a rag. The end cap comprises an attachment portion which attaches to the first rail. The end cap comprises a cover portion which covers over the first rail, and extends from the attachment portion. The cover portion having a front and a back and an interior. The cover portion having a rag holder comprising a first slot and a second slot which communicates through a channel in the interior of the cover portion that extends from the first lot to the second slot. Rag extending into the first slot and through the channel and out the second slot to be held by the rag holder. The end cap comprising a pad attached to the back of the cover portion which contacts a surface against which the first rail leans so as not to mar or scratch or damage the surface.

The present invention pertains to a method for using a ladder by a user. The method comprises the steps of climbing up the ladder by the user by stepping on rungs attached to a first rail and a second rail of the ladder. The ladder having an end cap that is attached adjacent to a top of the first rail. The end cap having an attachment portion which attaches to the first rail and a cover portion which covers over the first rail, and extends from the attachment portion. The cover portion having a front and a back and an interior. The cover portion having a rag holder comprising a first slot and a second slot which communicates through a channel in the interior of the cover portion that extends from the first slot to the second slot, and a pad attached to the back of the cover portion which contacts a surface against which the first rail leans so as not to mar or scratch or damage the surface. There is the step of inserting a rag into the rag holder so the rag extends into the first slot and through the channel and out the second slot and is held by the rag holder.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
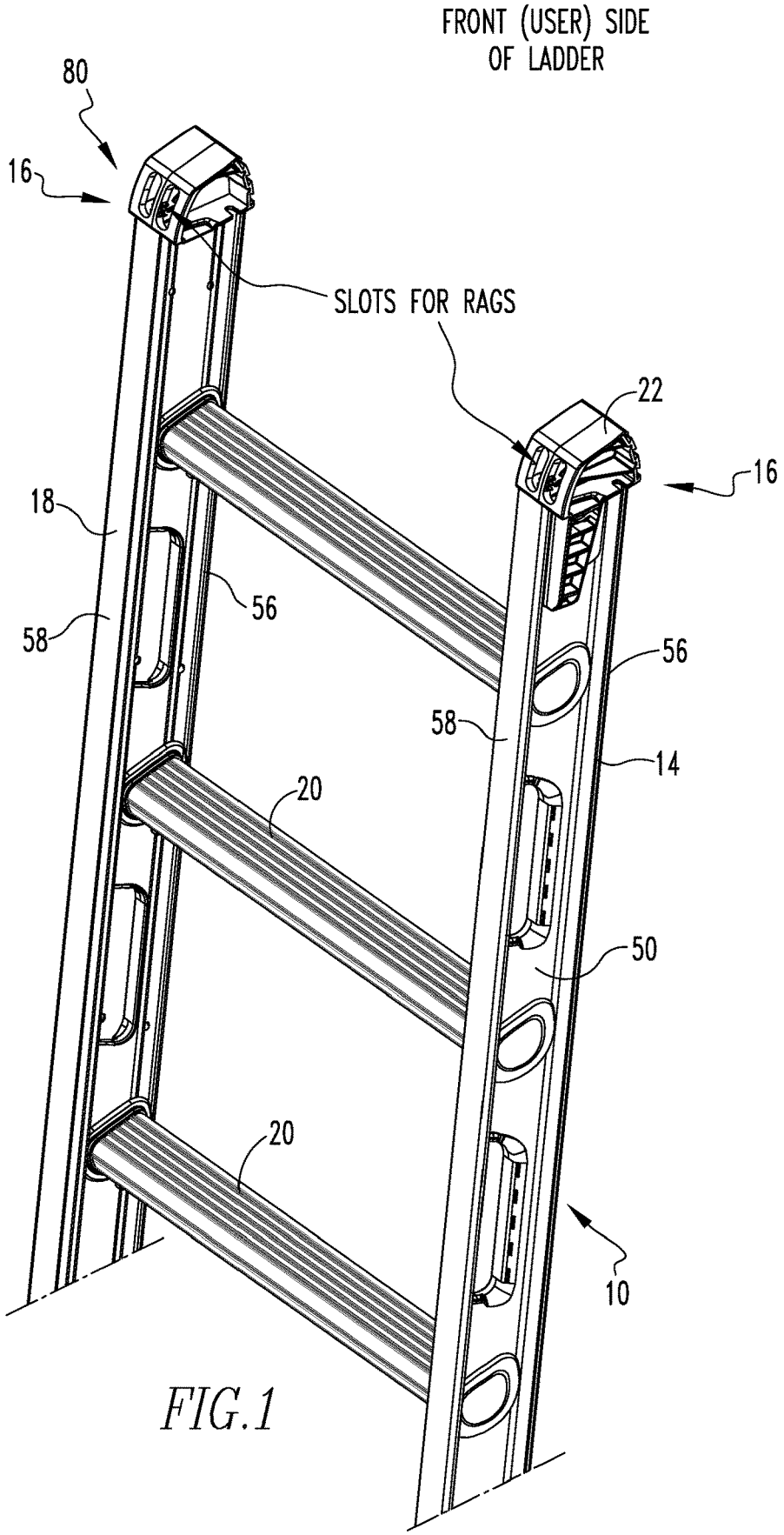
FIG. 1 shows a front perspective view of a ladder of the present invention.
Figure 2:
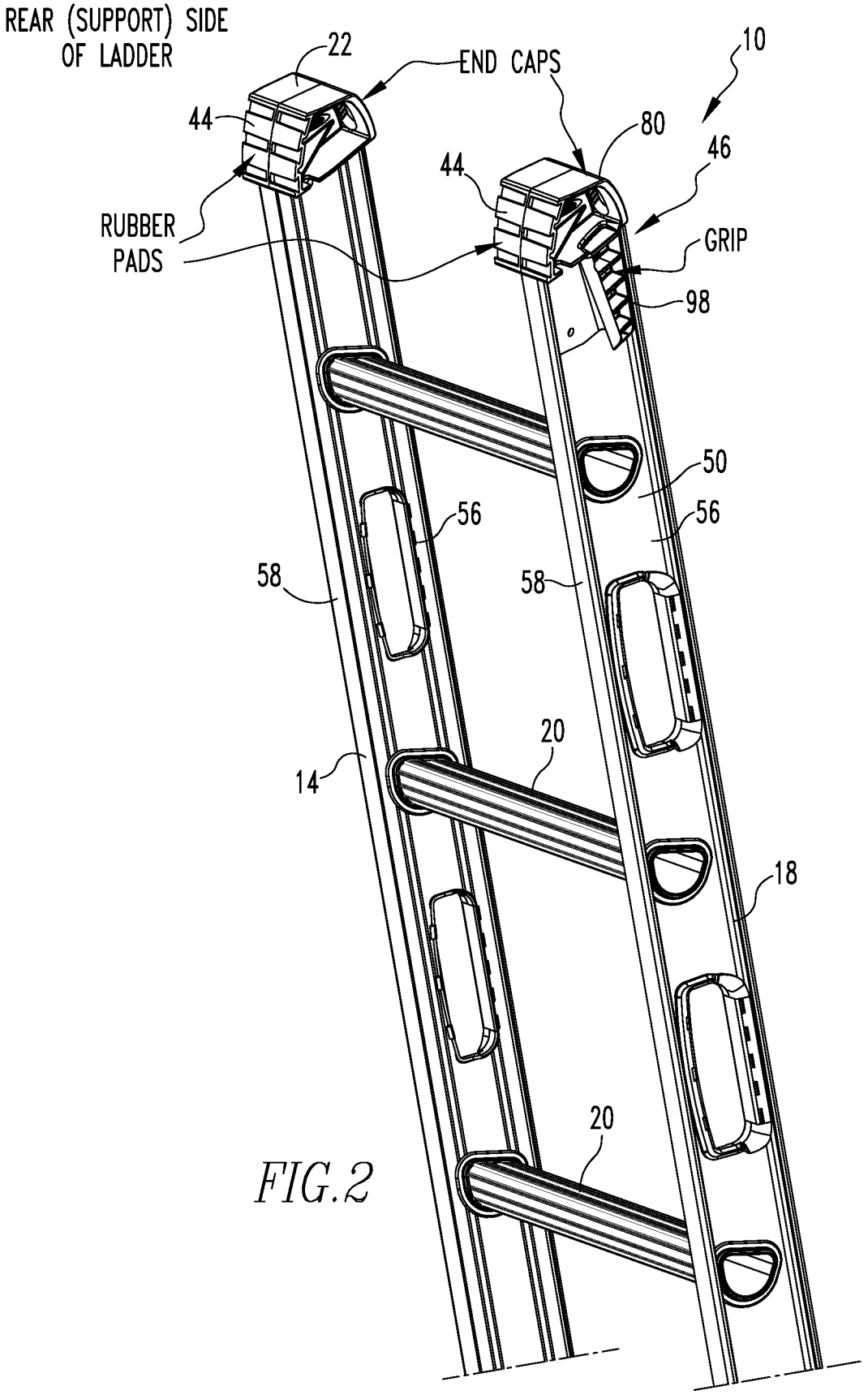
FIG. 2 shows a rear perspective view of the ladder.
Figure 3:
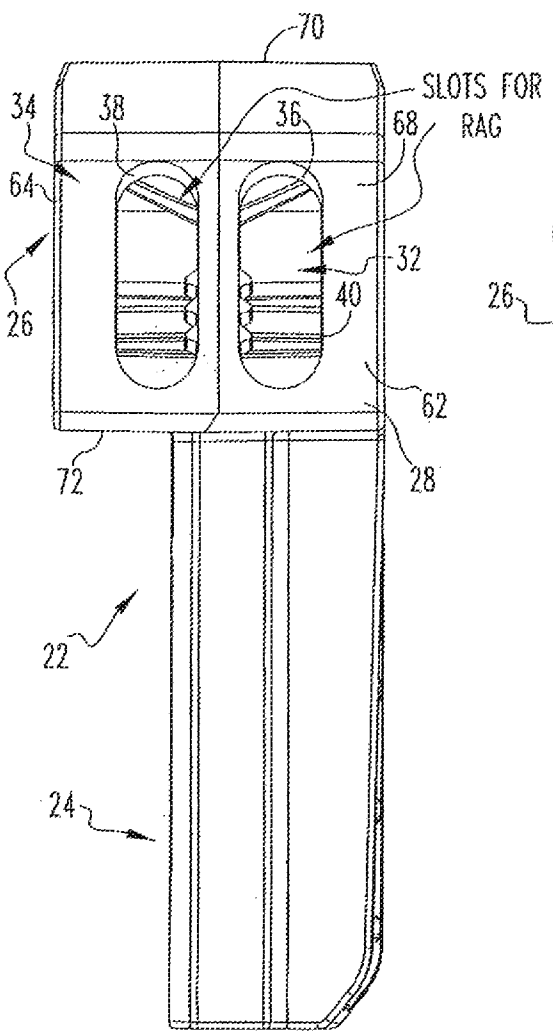
FIG. 3 shows a front view of an end cap.
Figure 7:
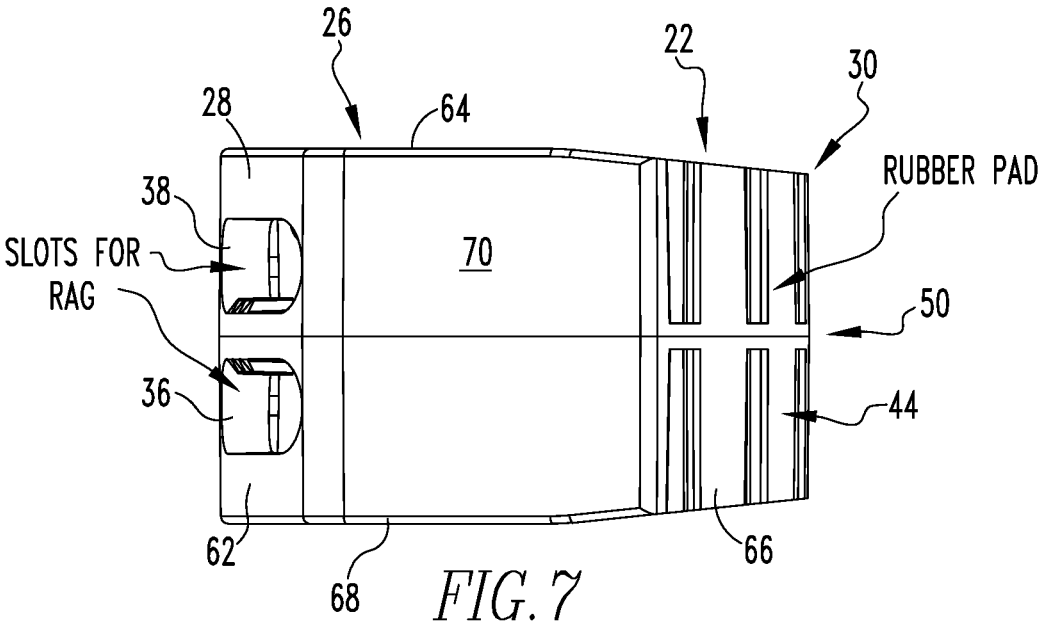
FIG. 7 shows an overhead view of the end cap.
Figure 8:
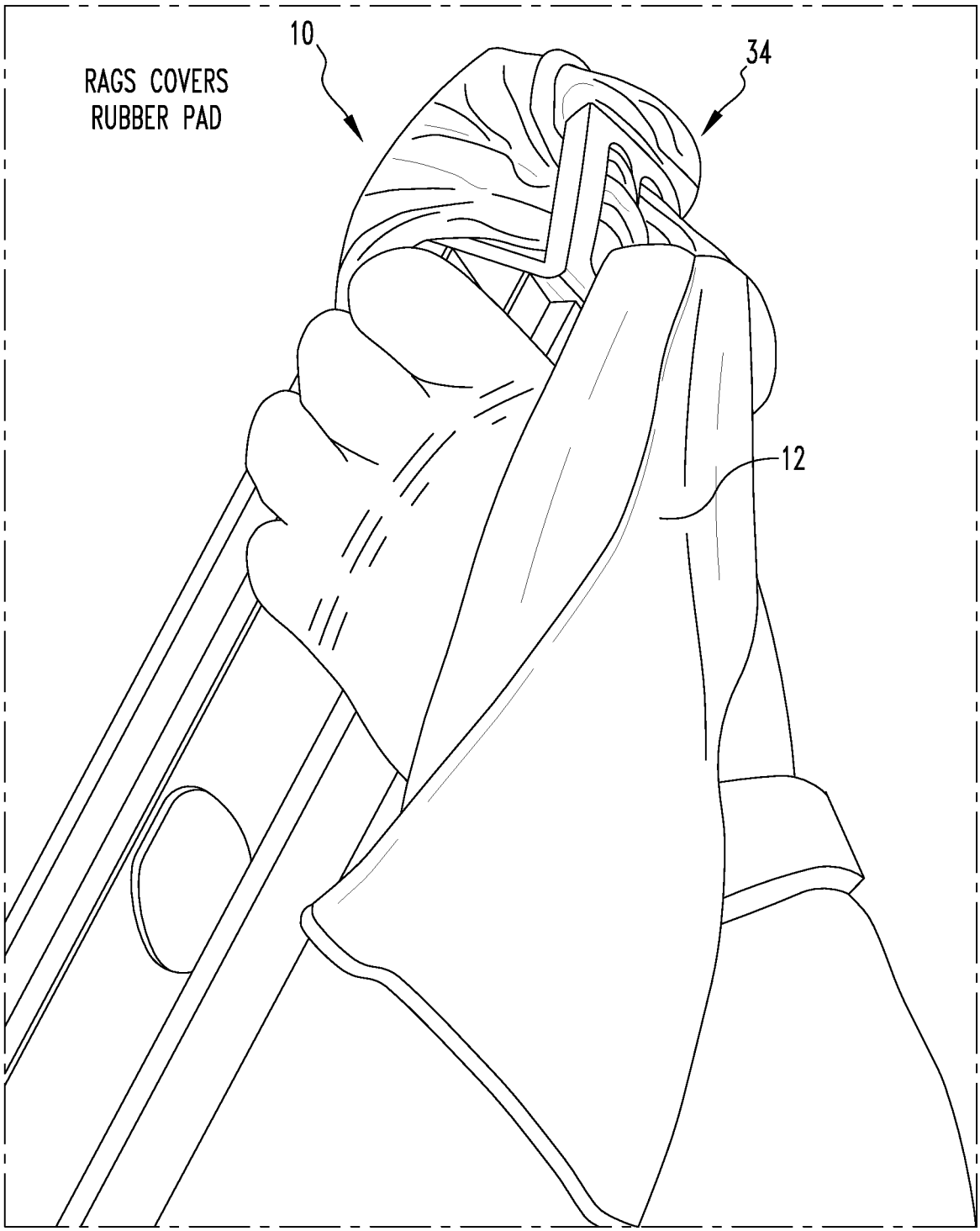
FIG. 8 shows the ladder with a rag in the rag holder.

Referring now to the drawings wherein like reference numerals refer to similar or identical parts throughout the several views, and more specifically to FIGS. 1, 2 and 8 thereof, there is shown a ladder 10 for a user to climb and which holds a rag 12. The ladder 10 comprises a first rail 14 having a top 16. The ladder 10 comprises a second rail 18. The ladder 10 comprises rungs 20 attached to the first rail 14 and second rail 18. The ladder 10 comprises an end cap 22 that is attached adjacent to the top 16 of the first rail 14. The end cap 22 has an attachment portion 24 which attaches to the first rail 14 and a cover portion 26 which covers over the first rail 14, and extends from the attachment portion 24. See FIGS. 3-7. The cover portion 26 has a front 28 and a back 30 and an interior 32, as shown in FIG. 3. The cover portion 26 has a rag holder 34 comprising a first slot 36 and a second slot 38 which communicates through a channel 40 in the interior 32 of the cover portion 26 that extends from the first slot 36 to the second slot 38. The rag 12 extends into the first slot 36 and through the channel 40 and out the second slot 38 to be held by the rag holder 34. The ladder 10 comprises a pad 44 attached to the back 30 of the cover portion 26, as shown in FIG. 5, which contacts a surface against which the first rail 14 leans so as not to mar or scratch or damage the surface.

Figure 5:
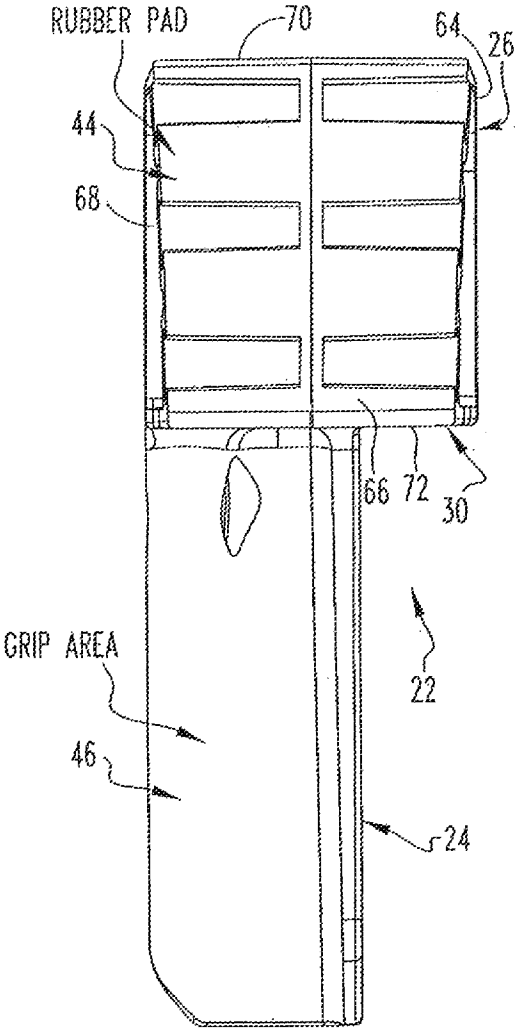
FIG. 5 shows a rear view of the end cap.
Figure 4:
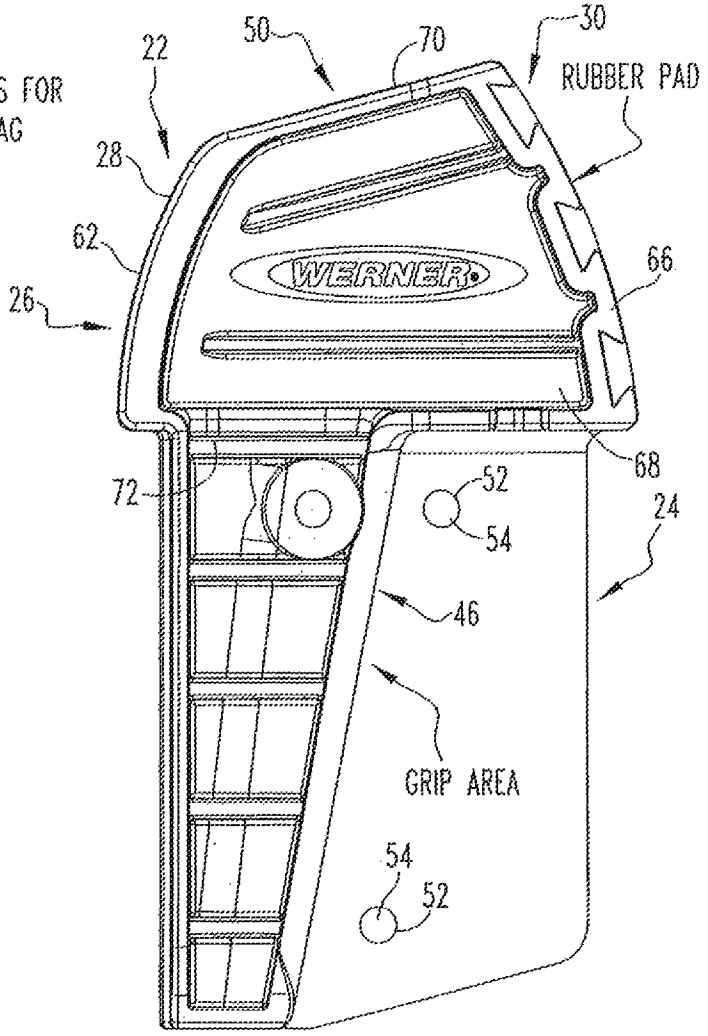
FIG. 4 shows a side view of the end cap.
Figure 6:
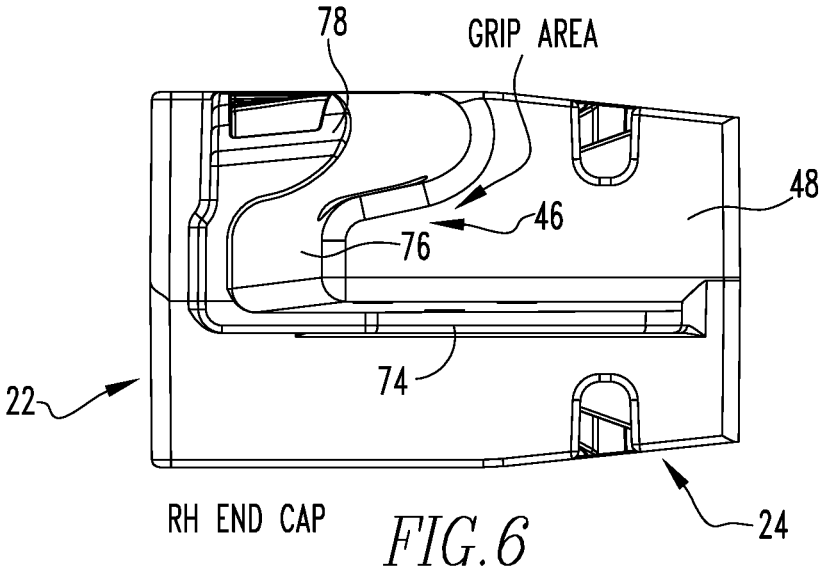
FIG. 6 shows a handle.

The end cap 22 may include a handle 46 which extends from the attachment portion 24, as shown in FIGS. 4-6. The first slot 36 and the second slot 38 of the rag holder 34 may be disposed in the front 28 of the cover portion 26. The attachment portion 24 may include a flat and rectangular plate 48 that conforms to a web 50 of the first rail 14. The plate 48 having a fastener hole 52 through which a fastener 54 extends into the web 50 to attach the end cap 22 to the first rail 14.

The cover portion 26 may cover the web 50 and a first flange 56 that extends from a first side 62 of the web 50 and a second flange 58 that extends from a second side 64 of the web 50 at the top 16 of the first rail 14. The cover portion 26 may form somewhat of an asymmetrical cube 60 with a first side 62 and a second side 64 attached to the first side 62 and the third side 66 attached to the second side 64 and a fourth side 68 attached to the third side 66 and the first side 62, and a top side 70 attached to the first side 62 and second side 64 and third side 66 and fourth side 68, and a bottom side 72 that attaches to the first side 62 and second side 64 and third side 66 and fourth side 68, as shown in FIGS. 4 and 7 and contacts the first flange 56 and second flange 58 and web 50 at the top 16 of the rail.

The handle 46 may have a wall 74, a stem 76 attached to the wall 74 and a grip 78 attached to the stem 76 that has a somewhat oval cross-section, as shown in FIG. 6. The wall 74 and the stem 76 and the grip 78 being one continuous solid piece and extending the same distance from the plate 48. The cover portion 26 and the attachment portion 24 may be one continuous piece.

The present invention pertains to an end cap 22 for a top 16 of a first ladder rail for holding a rag 12, as shown in FIGS. 3-7. The end cap 22 comprises an attachment portion 24 which attaches to the first rail 14. The end cap 22 comprises a cover portion 26 which covers over the first rail 14, and extends from the attachment portion 24. The cover portion 26 having a front 28 and a back 30 and an interior 32. The cover portion 26 having a rag holder 34 comprising a first slot 36 and a second slot 38 which communicates through a channel 40 in the interior 32 of the cover portion 26 that extends from the first lot to the second slot 38. Rag 12 extending into the first slot 36 and through the channel 40 and out the second slot 38 to be held by the rag holder 34. The end cap 22 comprising a pad 44 attached to the back 30 of the cover portion 26 which contacts a surface against which the first rail 14 leans so as not to mar or scratch or damage the surface.

The present invention pertains to a method for using a ladder 10 by a user. The method comprises the steps of climbing up the ladder 10 by the user by stepping on rungs 20 attached to a first rail 14 and a second rail 18 of the ladder 10. The ladder 10 having an end cap 22 that is attached adjacent to a top 16 of the first rail 14. The end cap 22 having an attachment portion 24 which attaches to the first rail 14 and a cover portion 26 which covers over the first rail 14, and extends from the attachment portion 24. The cover portion 26 having a front 28 and a back 30 and an interior 32. The cover portion 26 having a rag holder 34 comprising a first slot 36 and a second slot 38 which communicates through a channel 40 in the interior 32 of the cover portion 26 that extends from the first slot 36 to the second slot 38, and a pad 44 attached to the back 30 of the cover portion 26 which contacts a surface against which the first rail 14 leans so as not to mar or scratch or damage the surface. There is the step of inserting a rag 12 into the rag holder 34 so the rag 12 extends into the first slot 36 and through the channel 40 and out the second slot 38 and is held by the rag holder 34. There may be the step of the user grabbing handle 46 that extends from the attachment portion 24.

This invention comprises plastic end caps 22 attached to the extreme upper end of extension ladder 10 fly rails. The end cap 22 is formed with a handle 46 designed to give the user a comfortable place to hold onto while working at the top 16 of the ladder 10. The end cap 22 has a rubber pad 44 on its back 30 which prevents damage to whatever surface the ladder 10 may be resting against. A rag holder 34 formed in the end cap 22 provides the means to easily and securely bind a rag 12 to the end cap 22. The rag 12 provides further protection for the surface supporting the ladder 10, and places the rag 12 in a convenient position to be used by a user such as a painter.

The width and length of the cap corresponds to the width and length of the cross section of the first rail, but slightly larger to cover the first rail. As an example, the width of the cover portion is about 2 inches; the length of the cover portion 3.3 inches; the overall height from the bottom of the attachment portion to the top of the cover portion is about 5.3 inches; with the height of the attachment portion being about 3.4 inches; the height of the cover portion being about 2.1 inches; the width of the attachment portion being about 2 inches; each slot is about 1.2 inches tall and about 0.5 inches wide, with the edge of each slot closest to the side of the attachment portion being about 0.37 inches; and about 0.25 inches between the inner edges of the slots.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A ladder for a user to climb and which holds a rag comprising:

a first rail having a top;

a second rail;

rungs attached to the first rail and second rail; and an end cap that is attached adjacent to the top of the first rail, the end cap having an attachment portion which attaches to the first rail and a cover portion which covers over the first rail, and extends from the attachment portion, the cover portion having a front and a back and an interior, the cover portion having a rag holder comprising a first slot and a second slot, and a pad attached to the back of the cover portion which contacts a surface against which the first rail leans so as not to mar or scratch or damage the surface, the end cap includes a handle which extends from the attachment portion and below the cover portion and below the top of the first rail, the first slot and the second slot of the rag holder are disposed in the front of the cover portion, the attachment portion includes a flat and rectangular plate that conforms to a web of the first rail, the plate having a fastener hole through which a fastener extends into the web to attach the end cap to the first rail.

2. The ladder of claim 1 wherein the cover portion covers the web and a first flange that extends from a first side of the web and a second flange that extends from a second side of the web at the top of the first rail.

3. The ladder of claim 2 wherein the cover portion form an asymmetrical cube with a first side and a second side attached to the first side and a third side attached to the second side and a fourth side attached to the third side and the first side, and a top side attached to the first side and second side and third side and fourth side, and a bottom side that attaches to the first side and second side and third side and fourth side and contacts the first flange and second flange and web at the top of the first rail.

4. The ladder of claim 3 wherein the handle has a wall, a stem attached to the wall and a grip attached to the stem has an oval cross-section, the wall and the stem and the grip being one continuous solid piece and extending a same distance from the plate.

5. The ladder of claim 4 where the cover portion and the attachment portion are one continuous piece.

6. An end cap for a top of a first ladder rail for holding a rag comprising:

an attachment portion which attaches to the first ladder rail;

a cover portion which covers over the first ladder rail, and extends from the attachment portion, the cover portion having a front and a back and an interior, the cover portion having a rag holder comprising a first slot and a second slot, the first slot and the second slot of the rag holder are disposed in the front of the cover portion, the attachment portion includes a flat and rectangular plate that conforms to a web of the first rail, the plate having a fastener hole through which a fastener extends into the web to attach the end cap to the first rail;

a pad attached to the back of the cover portion which contacts a surface against which the first rail leans so as not to mar or scratch or damage the surface; and a handle which extends from the attachment portion and below the cover portion and below the top of the first ladder rail.

* * * * *